US007484728B2

(12) United States Patent
Yonemoto

(10) Patent No.: US 7,484,728 B2
(45) Date of Patent: Feb. 3, 2009

(54) PAPER STORAGE DEVICE

(75) Inventor: Satoru Yonemoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/819,152

(22) Filed: Jun. 25, 2007

(65) Prior Publication Data

US 2008/0001345 A1 Jan. 3, 2008

(51) Int. Cl.
*B65H 1/00* (2006.01)

(52) U.S. Cl. ..... 271/171; 271/145; 271/144; 399/393; 347/104

(58) Field of Classification Search ..... 271/171, 271/145, 144; 399/393; 347/104
See application file for complete search history.

(56) References Cited

U.S. PATENT DOCUMENTS 6,254,086 B1 * 7/2001 Sunou et al. ..... 271/171
6,871,848 B2 * 3/2005 Matsushima et al. ..... 271/171
2006/0267270 A1 * 11/2006 Suzuki et al. ..... 271/171
2007/0290434 A1 * 12/2007 Ishida ..... 271/171

FOREIGN PATENT DOCUMENTS

| | | |
|---|---|---|
| JP | 63-208438 | 8/1988 |
| JP | 2004-123396 | 4/2004 |
| JP | 2005-126150 | 5/2005 |

* cited by examiner

*Primary Examiner*—Patrick H Mackey
*Assistant Examiner*—Luis Gonzalez
(74) *Attorney, Agent, or Firm*—Smith, Gambrell & Russell, LLP

(57) ABSTRACT

On a center of the front surface of a positioning member 10, positioning projections 25*a* to 25*d* are provided in line in such a manner as to project therefrom. On both a left and a right sides of the positioning projections 25*a* to 25*d*, scales 27*a* displaying metric paper sizes and scales 27*b* displaying inch-based paper sizes are inscribed. The positioning member 10 is horizontally inverted through 180 degrees and a direction indication line 29*a* on the scale 27*a* side or a direction indication line 29*b* on the scale 27*b* side is aligned with a fitting reference line 30 for fixation to the positioning member 10, thereby permitting switching between positioning for a metric paper size and positioning for an inch-based paper size.

10 Claims, 7 Drawing Sheets

PAPER STORAGE DEVICE

BACKGROUND OF THE INVENTION

This application is based on Japanese Patent Application No. 2006-180139 filed on Jun. 29, 2006, the contents of which are hereby incorporated by reference.

1. Field of the Invention

The present invention relates to a large-capacity paper storage device which stores paper and also which feeds the paper to an image forming apparatus, such as a copier, a printer, a facsimile, or the like. The invention more specifically relates to a method of reliably positioning at a predetermined position a width regulating member which regulates a side end of paper regardless of a paper size.

2. Description of Related Art

For example, sharing of one image forming apparatus by a large number of users increases paper consumption per image forming apparatus. Thus, an image forming apparatus has been in development which is loaded with a large-capacity paper storage device capable of storing a larger number of paper. In such a large-capacity paper storage device, paper is resupplied by the thousands. Thus, upon paper resupply, the user resupplies the paper into a paper storage cassette (paper storage section) a plurality of times.

FIG. 7 is a plan view of a conventional large-capacity paper storage device. FIG. 8 is a side sectional view of the paper storage device (cross section taken along line AA' of FIG. 7). The paper storage device 100 is of a large-capacity type capable of storing paper by the thousands, in which paper is resupplied from above a paper storage cassette 1. Numeral 2 denotes an elevating plate which is vertically elevatable in the paper storage cassette 1. The elevating plate 2 is driven by an elevator (not shown) composed of wires, a take-up pulley, and the like. The paper storage device 100 is coupled to an image forming apparatus (not shown) adjacent thereto on the left of FIG. 8. Once image formation is started, paper 3 inside the paper storage cassette 1 is sequentially fed into the image forming apparatus through the paper feed section 4. The timing of feeding the paper 3 by the paper feed section 4 is controlled by a control signal transmitted from a control section on the image forming apparatus side.

On the bottom surface 1*a* of the paper storage cassette 1, a pair of width regulating members 5*a* and 5*b* for positioning paper in the width direction and a posterior end regulating member 6 for aligning the posterior ends of paper are vertically provided in such a manner as to penetrate through holes 2*a*, 2*b*, and 2*c* formed in the elevating plate 2. In the elevating plate 2, in addition to the through holes 2*a* to 2*c*, a plurality of through holes or notched parts (not shown) are provided. Any of the through holes or the notched parts can be selected and the width regulating members 5*a* and 5*b* and the posterior end regulating member 6 can be arranged at positions in accordance with a predetermined paper size to thereby store paper of the predetermined size at a predetermined position in the paper storage cassette 1.

A conventional large-capacity paper feed cassette is typically configured, as described above, to be capable of adjusting in a stepwise manner the positions of the width regulating members 5*a* and 5*b* in accordance with so called regular paper sizes, such as A4, B4, and the like. Or, the conventional large-capacity paper feed cassette is configured, as disclosed in patent documents 1 and 2, to be capable of free adjustment in accordance with various paper sizes not limited to the regular sizes.

On a paper feed cassette that performs paper feeding with respect to the widthwise center of paper as a reference (center reference), when two types of paper, for example, paper in an A4-size (with a width of 210 mm) and paper in a letter size R (with a width of 8.5 inches=216 mm) are loaded, a difference in the distance from the center reference to the paper side end between the two types of paper is only 3 mm, and thus their left and right width regulating members need to be adjusted by shifting of 3 mm.

Now, for example, to perform positioning with the upper ends of the width regulating members 5*a* and 5*b* being bent horizontally and with a positioning hole on the width regulating member side brought into engagement with a positioning projection on the cassette body side, the positioning projections respectively corresponding to the A4 size and the letter size need to be located in extreme proximity (at an interval of 3 mm), which possibly results in adjustment to a wrong position with respect to the paper size. Moreover, to avoid, upon engagement of the positioning hole with one of the projections, interference with another one of the projections, fitting sections of the width regulating members need to be configured in a complicated manner.

A possible method of avoiding the problems as described above is to provide two positioning members which have positioning projections respectively corresponding to a metric paper size and an inch-based paper size provided separately from each other and then selectively use them in accordance with the paper size. However, this method leads to an increase in the number of components.

Further, a too narrow width of the width regulating member for the paper width results in load which causes paper jam upon paper transport. On the other hand, a too broad width of the width regulating member for the paper width results in paper misalignment in the width direction, thus causing paper skew. However, even commercially available paper of a regular size has some size variation. Thus, the configuration such that the width regulating member is finely adjusted in a stepwise manner in accordance with paper of a regular size fails to finely adjust the width of the width regulating member in accordance with paper size variation. Even the configuration as in patent documents 1 and 2 such that adjustment can be freely made in accordance with a paper size provides no reference for adjustment upon positioning the width regulating member, thus resulting in difficulty in delicate position adjustment.

On the other hand, patent document 3 discloses a paper feed cassette in which a positioning member for regulating members can be switched accordingly between an inch-based paper size and a metric paper size. However, the method disclosed by the patent document 3 is based on the assumption that the regulating members are used for a paper feed cassette of a type in which the regulating members slide along the cassette bottom surface. Thus, this method is hard to apply to positioning of a width regulating member which is used in the large-capacity paper storage device 100 as described in FIG. 8, which is long in the paper loading direction, and which is engaged and fixed with the cassette body.

| | |
|---|---|
| [Patent Document 1] | JP-A-S63-208438 |
| [Patent Document 2] | JP-A-2004-123396 |
| [Patent Document 3] | JP-A-2005-126150 |

SUMMARY OF THE INVENTION

In view of the problems described above, it is an object of the present invention to provide a large-capacity paper storage device capable of easily positioning a width regulating member that aligns a paper width direction regardless of whether a paper size is inch-based or metric.

In order to achieve the object described above, one aspect of the invention refers to a paper storage device including: a paper storage section which stores paper; an elevating plate which is vertically movable in the paper storage section; and a width regulating member which has both ends thereof detachably supported on a bottom surface and a top surface of the paper storage section and which projects further above a highest elevation position of the elevating plate. The paper storage device performs positioning of the width regulating member in a direction orthogonal to a paper transport direction to thereby align widthwise ends of paper of a plurality of sizes stored on the elevating plate to regulate paper storage position. On the top surface of the paper storage section, a positioning member is arranged which has a plurality of second engagement sections selectively engaging with a first engagement section on the width regulating member side and a plurality of scales which display paper sizes respectively corresponding to the second engagement sections. The positioning member is so arranged as to be horizontally inverted through 180 degrees, thereby permitting switching between positioning corresponding to a metric paper size and positioning corresponding to an inch-based paper size.

With this configuration, just by inverting the fitting direction of the positioning member through 180 degrees, positioning of the width regulating member corresponding to a metric or an inch-based paper size can be achieved, which does not require separately providing positioning members respectively corresponding to a metric size and an inch-based size. Moreover, as is the case with the A4 size and the letter size, even when the width regulating members are arranged in proximity to each other, operation of adjusting the width regulating members can be performed quickly and reliably. Further, shapes and structure of the positioning member and the width regulating members are simplified, which is advantageous in terms of design and costs of the paper storage device.

With the invention, in the paper storage device with the configuration described above, the plurality of scales are provided on left and right of the second engagement sections separately for a metric paper size and an inch-based paper size, and when the first engagement section is engaged with the second engagement section in accordance with arrangement of the positioning member, the scale displaying the paper size corresponding to this second engagement section faces a mark line on the width regulating member side.

With this configuration, on the left and right of the positioning member, scales are provided separately for a metric paper size and an inch-based paper size, and when the first engagement section is engaged with the second engagement section in accordance with the arrangement of the positioning member, the scale displaying the paper size corresponding to this second engagement section faces the mark line on the width regulating member side, thereby permitting the operator to easily confirm paper size setting.

With the invention, in the paper storage device with the configuration described above, on both a left and a right ends of the positioning member, a direction indication line is provided which is aligned with a fitting reference line on the top surface of the paper storage section to determine arrangement direction of the positioning member.

With this configuration, the direction indication line for determining the arrangement direction of the positioning member is provided on both the left and right ends of the positioning member, and either of the direction indication lines is aligned with the fitting reference line on the top surface of the paper storage section, thereby permitting easily determining the arrangement of the positioning member in accordance with the metric paper size or the inch-based paper size.

With the invention, in the paper storage device with the configuration described above, the first engagement section and the second engagement section are engaged with each other with a predetermined clearance being provided therebetween in a moving direction of the width regulating member, and the width regulating member is slidably fixed to the positioning member within the clearance.

With this configuration, the engagement between the first engagement section and the second engagement section with the predetermined clearance being provided in the moving direction of the width regulating member permits fine adjustment of the width regulating member in accordance with paper width variation within the clearance between the first engagement section and the second engagement section, thus effectively suppressing paper skew and paper jam.

With the invention, in the paper storage device with the configuration described above, the first engagement section is a positioning hole formed in the width regulating member, the second engagement section is a positioning projection formed in the positioning member and engaging with the positioning hole, and the width regulating member is provided with an opening for, when the positioning hole is engaged with any of the positioning projections, avoiding interference with the other positioning projections.

With this configuration, the first engagement section on the width regulating member side and the second engagements section on the positioning member side can be easily provided, making it easy to manufacture the width regulating member and the positioning member.

With the invention, in the paper storage device with the configuration described above, relationship (inch-based paper size width)/2+2L=(metric paper size width)/2 is satisfied where a distance from a straight line passing through a rotational center of the positioning member and vertical to a movement direction of the width regulating member to any of the second engagement sections is L.

With this configuration, any of the second engagement sections can be used for both positioning for an inch-based size and positioning for the metric size, thus reducing the number of second engagement sections.

With the invention, in the paper storage device with the configuration described above, the second engagement section satisfying the relationship (inch-based paper size width)/2+2L=(metric paper size width)/2 corresponds to a minimum inch-based paper size width and a maximum metric paper size width.

With this configuration, width of the positioning member in the moving direction of the width regulating member can be minimized.

DETAILED DESCRIPTION OF THE PREFERRED EMBODIMENTS

Figure 1:
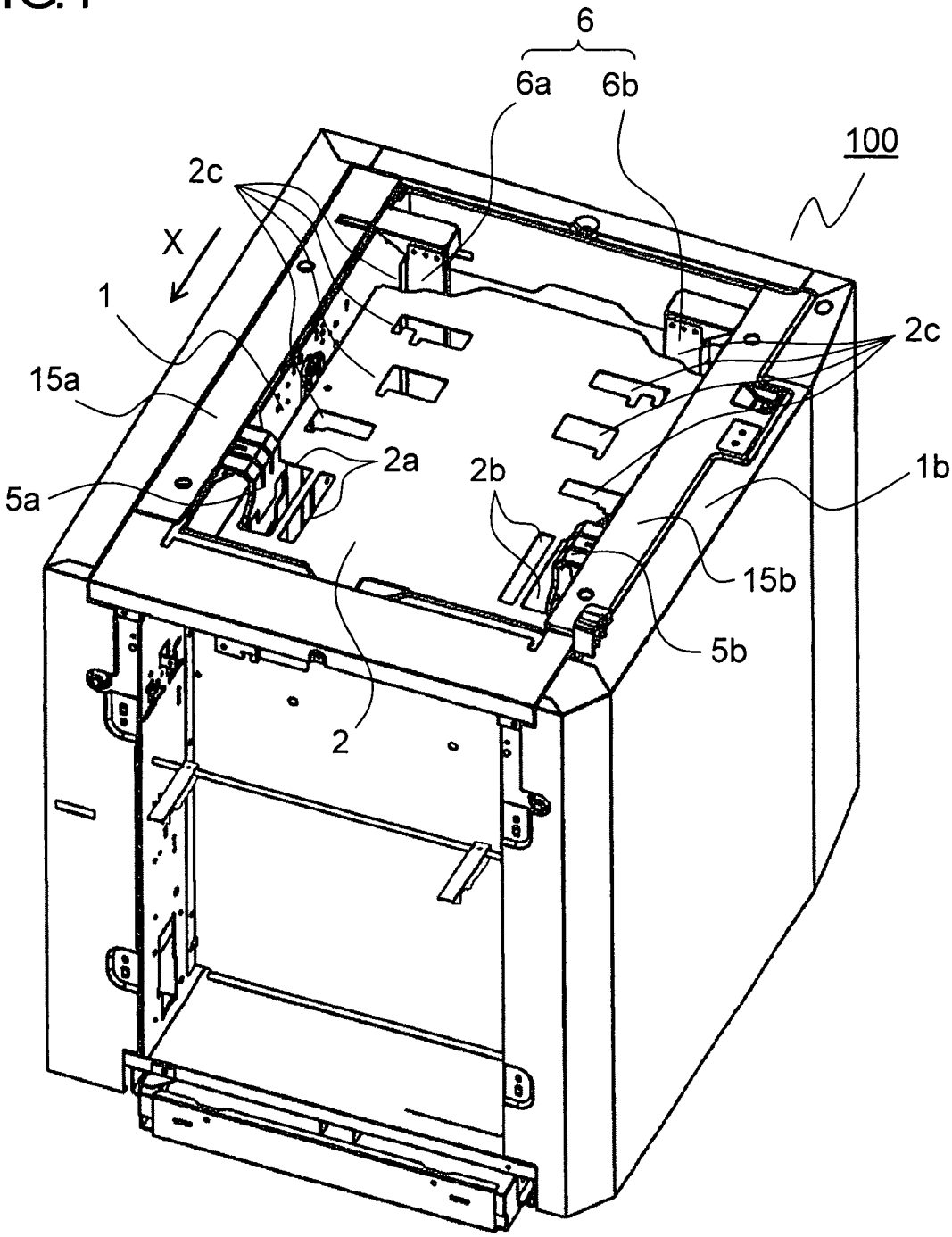
FIG. 1 is an external perspective view of a paper storage device of the present invention.
Figure 7:
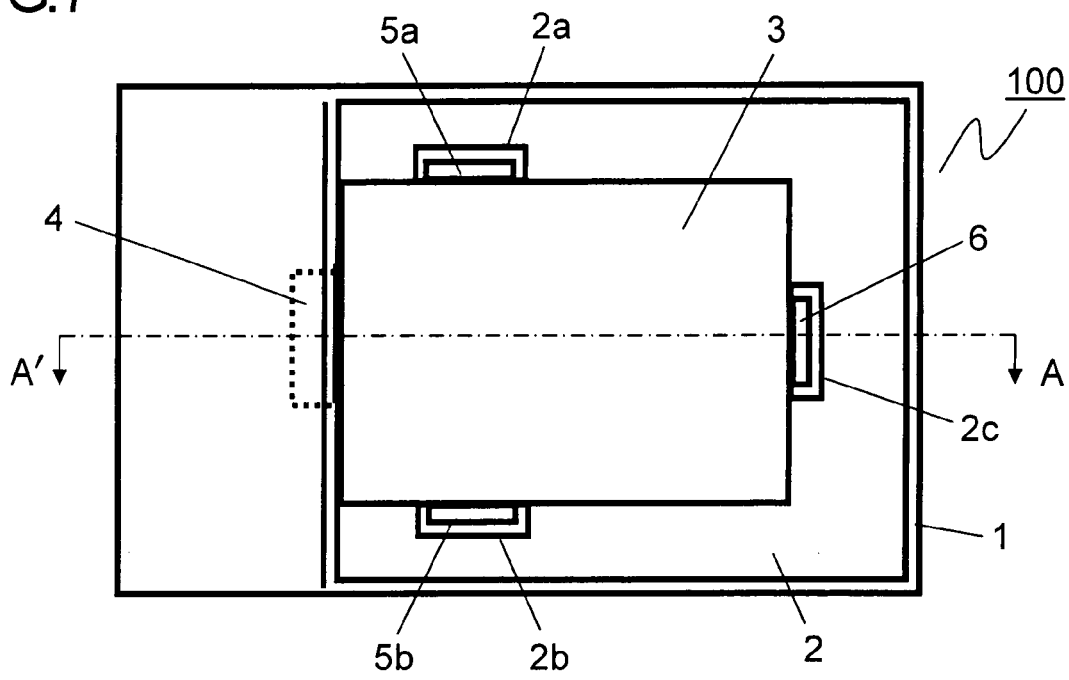
FIG. 7 is a plan view of a conventional large-capacity type paper storage device.
Figure 8:
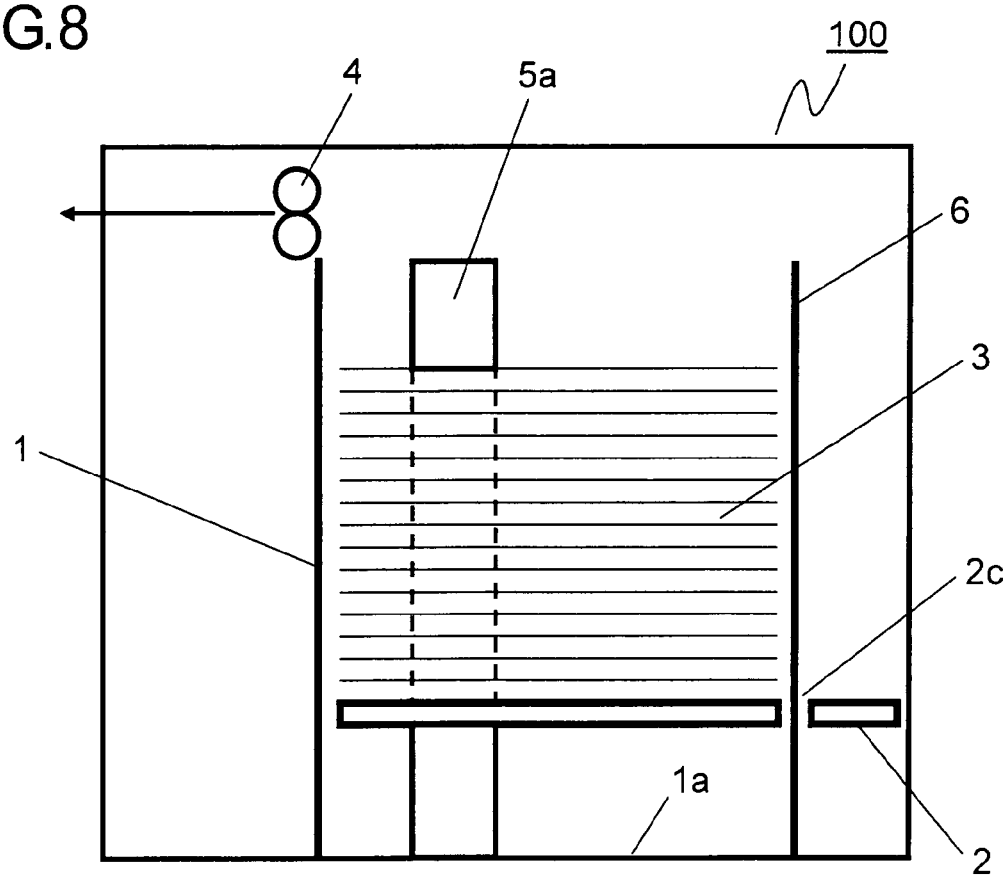
FIG. 8 is a side sectional view of the conventional large-capacity type paper storage device.

Hereinafter, embodiments of the present invention will be described with reference to the accompanying drawings. FIG. 1 is an external perspective view of a paper storage device of the invention as viewed from the side thereof connected to an image forming apparatus (left side of FIG. 8). Portions in common with those in FIGS. 7 and 8 showing the conventional example are provided with the same numerals and thus omitted from the description. The paper storage device 100 of FIG. 1 can store approximately 4000 pieces of paper (80 g/m2 in texture weight) in a paper storage cassette 1, and has an elevating plate 2 provided with two through holes 2*a* and two through holes 2*b* through which width regulating members 5*a* and 5*b* respectively penetrate.

Posterior end regulating members 6 are composed of: a left posterior end regulating member 6*a* arranged on the left side and a right posterior end regulating member 6*b* arranged on the right side, both as viewed from the downstream side along a paper transport direction (direction of an arrow X). The elevating plate 2 has four through holes 2*c* each (eight in total) provided on the left and right thereof. The through holes 2*c* permit the posterior end regulating members 6 to penetrate therethrough. On a top surface 1*b* of the paper storage cassette 1, covering members 15*a* and 15*b* are fitted which respectively cover boss sections 8 and positioning members 10 (see FIG. 2) to be described later. Instead of the through holes 2*a* to 2*c*, for example, C-shaped notched parts may be formed in the elevating plate 2 to thereby avoid interference between the elevating plate 2, the width regulating members 5*a* and 5*b*, and the posterior end regulating members 6.

Figure 2:
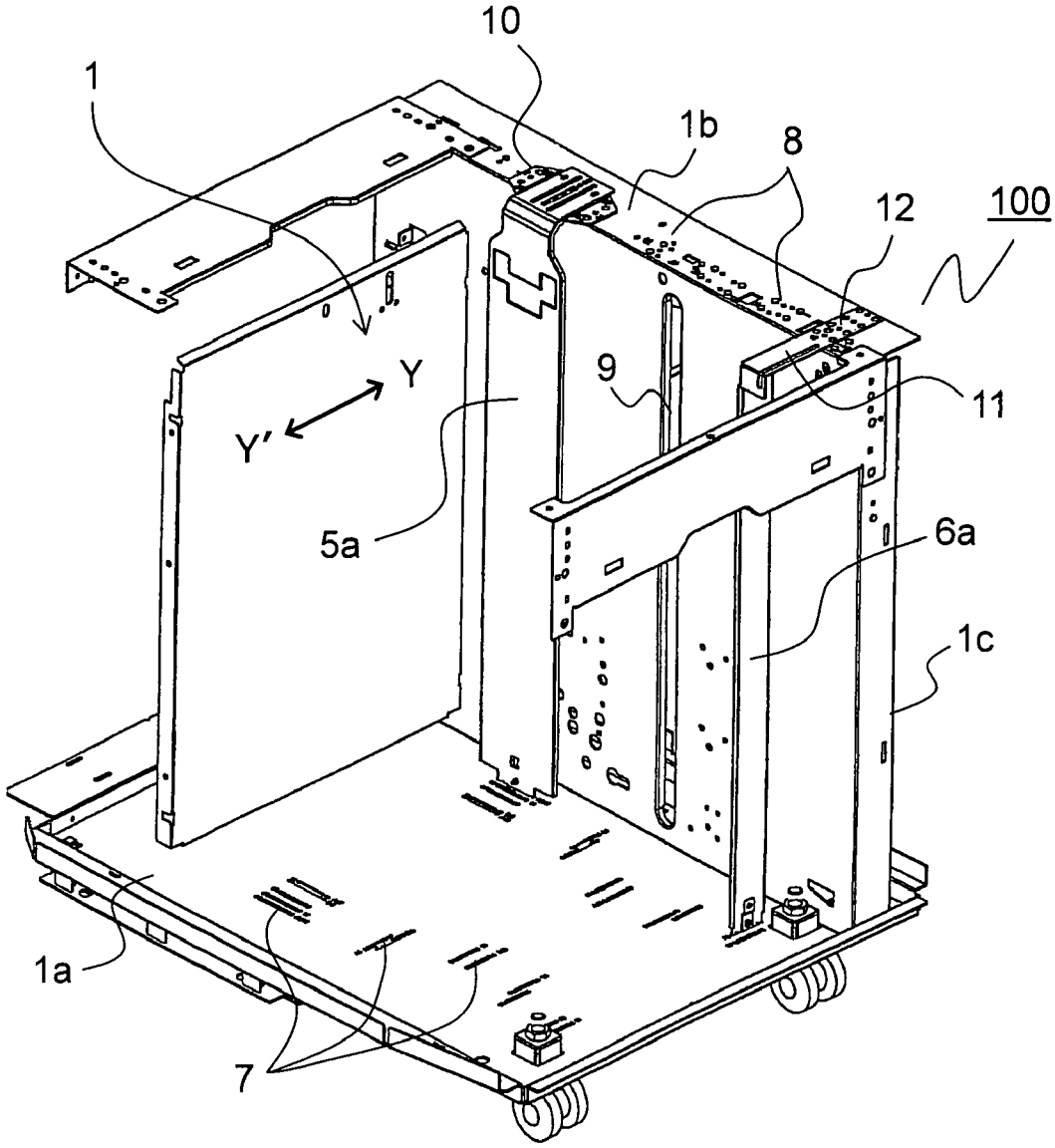
FIG. 2 is a sectional perspective view showing internal structure of the paper storage device of the invention.

FIG. 2 is a sectional perspective view showing internal structure of the paper storage device. For explanatory purposes only, the width regulating member 5*b*, the right posterior end regulating member 6*b*, and the elevating plate 2 are omitted from the illustration, and only the left side structure as viewed from the downstream along the transport direction is illustrated. Note that the same description applies to the right side structure.

In the bottom surface 1*a* of the paper storage cassette 1, a plurality of slits 7 are drilled, the slits 7 are selected in accordance with the paper size, and then the lower ends of the width regulating member 5*a* and the left posterior end regulating member 6*a* are inserted therein and fixed. On the top surface 1*b* of the paper storage cassette 1, the positioning member 10 is fixed which positions the width regulating member 5*a* in the direction (direction of an arrow YY' in the figure) orthogonal to the paper transport direction. Via this positioning member 10, the width regulating member 5*a* is fixed to the paper storage cassette 1. Moreover, in a top surface 1*b*, the boss sections 8 which engage with engagement holes 12 provided in a support section 11 at the upper end of the left posterior end regulating member 6*a* are formed at a plurality of positions. Formed in a side plate 1*c* of the paper storage cassette 1 is a guide hole 9, along which the elevating plate 2 (see FIG. 1) moves vertically while kept in a horizontal state.

The invention is characterized in that positioning a metric paper size and positioning an inch-based paper size can be switched by horizontally inverting the positioning member 10 through 180 degrees. This permits position adjustment of the width regulating members 5*a* and 5*b* by using one member regardless of whether or not the paper size is metric or inch-based, so that positioning in the direction (paper width direction) orthogonal to the paper transport direction can be performed easily and reliably.

Next, methods of setting a paper size in the paper storage device according to the invention, particularly the method of fixing the width regulating members 5*a* and 5*b* and the method of position adjustment associated with paper size change, will be described in detail, by using FIGS. 3 to 6 with reference to FIGS. 1 and 2.

Figure 3:
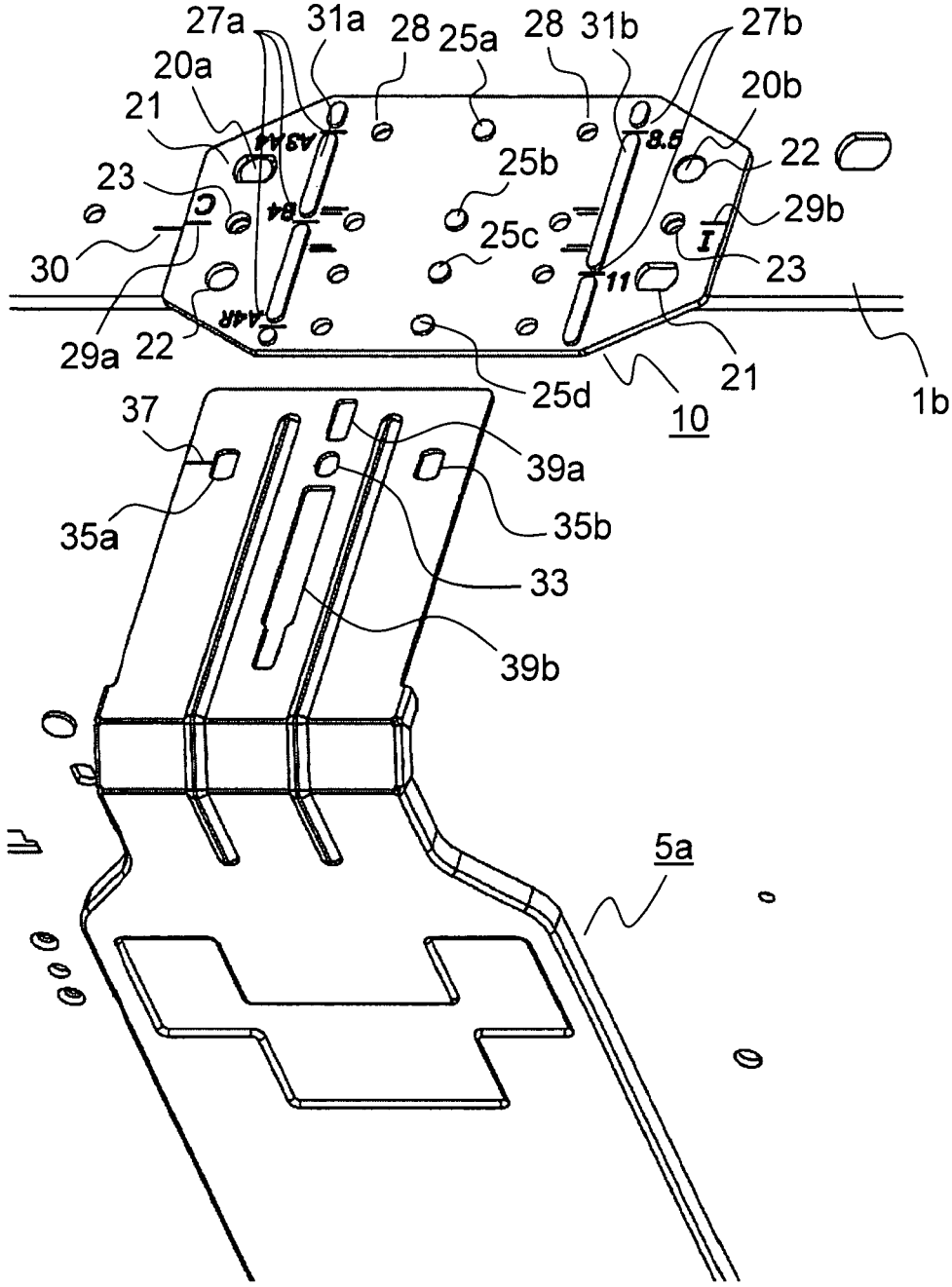
FIG. 3 is an enlarged perspective view of the surrounding of a positioning member when a width regulating member is set in accordance with a metric paper size in the paper storage device of the invention.

First, the description will be given, referring to a case where the paper storage device is set for a metric paper size. FIG. 3 is an enlarged perspective view of the surrounding of the positioning member when the width regulating member is set in accordance with a metric paper size. FIG. 4 is a top enlarged view of the surrounding of the positioning member showing a condition that the width regulating member is set for the A4R size. Portions also common with those in FIGS. 1 and 2 are provided with the same numerals and thus omitted from the description. FIG. 3 shows the structure on the width regulating member 5*a* side only, but exactly the same applies to the structure on the width regulating member 5*b* side. FIG. 4 shows a condition with the covering members 15*a* and 15*b* (see FIG. 1) removed.

As shown in FIG. 3, the positioning member 10 is a horizontally long, octagonal steel plate member, with a pair of boss holes 21 and a pair of boss holes 22 respectively formed at diagonal positions of four corners thereof. Through engagement of one set of the boss holes 21 and 22 (at the top in FIG. 3) with support bosses 20*a* and 20*b* provided on the top surface 1*b* in such a manner as to project therefrom, the positioning member 10 is positioned at a predetermined position. Note that inverting the positioning member 10 through 180 degrees engages another set of the boss holes 21 and 22 (at the bottom in FIG. 3) with the support bosses 20*a* and 20*b*.

Formed at two positions, on the longitudinal left and right, of the positioning member 10 are screw holes 23 for threadably securing to the top surface 1*b*. On the center of the front surface of the positioning member 10, positioning projections (second engagement sections) 25*a* to 25*d* are provided in line in such a manner as to project therefrom. Respectively inscribed on the left and right sides of the positioning projection 25*a* to 25*d* are scales 27*a* for displaying metric paper sizes (A4R, B4, A3, and A4) and scales 27*b* for displaying inch-based paper sizes (8.5 inches and 11 inches). The scales 27*a* and 27*b* are located at equal distance from their corresponding positioning projections 25*a* to 25*d*.

Respectively inscribed on the left and right ends of the positioning member 10 are direction indication lines 29*a* and 29*b* which determine the direction of fitting to the top surface 1*b*. In FIG. 3, the positioning member 10 is arranged so that the direction indication line 29*a* on the scale 27*a* side where a letter "C" for metric display is marked coincides with a fitting reference line 30 on the top surface 1*b*, so that the width regulating member 5*a* can be set in accordance with the metric paper size. Numerals 31*a* and 31*b* denote guide sections for preventing wobbling of the width regulating member 5*a*, and are each provided in parallel to the positioning projections 25*a* to 25*d* in such a manner as to project. On the left and right of the positioning projections 25*a* to 25*d*, screw holes 28 for fixing together the width regulating member 5*a* and the positioning member 10 are formed in a pair for the positioning projections 25*a* to 25*d*, respectively.

The upper end of the width regulating member 5*a* is horizontally bent and formed with a positioning hole (first engagement section) 33 with which the positioning projections 25*a* to 25*d* are selectively engaged. In the both sides of the positioning hole 33, through holes 35*a* and 35*b* are formed at positions coinciding with the corresponding screw holes 28 when the positioning hole 33 is engaged with any one of the positioning projections 25*a* to 25*d*, and on the through hole 35*a* side, a mark line 37 is inscribed which faces the scales 27*a*.

Numerals 39*a* and 39*b* denote openings for, when the positioning hole 33 is engaged with any one of the positioning projections 25*a* to 25*d*, avoiding interference between the width regulating member 5*a* and the other positioning projections. In FIG. 3, engaging the positioning hole 33 with any one of the positioning projections 25*a*, 25*b*, and 25*d* permits positioning corresponding to any of a total of four kinds of paper sizes including A3, A4, B4, and A4R.

For example, in order to set the paper size at A4R, the lower ends of the width regulating members 5*a* and 5*b* are inserted in the slit 7 corresponding to A4R, and also as shown in FIG. 4, the upper ends of the width regulating members 5*a* and 5*b* are slid along the guide sections 31*a* and 31*b* to engage the positioning hole 33 with the positioning projection 25*d* corresponding to the A4R size. In this condition, the mark line 37 faces a display "A4R" of the scale 27*a*, which permits the operator to easily confirm the size setting. Moreover, fitting of the positioning projection 25*c* with the opening 39*a* permits avoiding interference between the width regulating members 5*a* and 5*b*.

The positioning hole 33 is formed into a long hole in parallel to the movement direction (paper width direction) of the width regulating members 5*a* and 5*b*, thus forming a predetermined clearance in the movement direction of the width regulating members 5*a* and 5*b* when engaged with any one of the positioning projections 25*a* to 25*d*. Therefore, for example, even when there is variation in the widths of paper of a regular paper size, arrangement of the width regulating members 5*a* and 5*b* can be finely adjusted in accordance with the variation within this clearance, providing an appropriate interval between the width regulating members 5*a* and 5*b* and the widthwise end of the paper to thereby inhibit paper skew and paper jam. The adjustable range may be appropriately set in accordance with a range of paper width variation, but a range within approximately +1 mm from the specified size position is typically satisfactory.

The width regulating members 5*a* and 5*b* are vertically long (approximately several tens of centimeters); thus, as a result of fine adjustment with the lower ends thereof in a fixed state, the width regulating members 5*a* and 5*b* are held in such a manner as to be slightly bent. This however does not interfere with the vertical movement of the elevating plate 2 since a predetermined clearance is provided between the through holes 2*a*, 2*b* and the width regulating members 5*a*, 5*b*. Further, only the interval at the upper end surrounding area between the width regulating members 5*a* and 5*b* has influence on paper transportation; thus, there is no risk of influence on the paper transportation even when there is no change in the interval at the lower ends.

With the width regulating members 5*a* and 5*b* finely adjusted, adjustment screws (not shown) are fastened to the pair of screw holes 28 corresponding to the positioning projection 25*d* via the through holes 35*a* and 35*b* so formed as to be long in the same direction as the positioning hole 33 to thereby fix together the width regulating members 5*a* and 5*b* and the positioning member 10. Thereafter, similarly, the lower ends of the posterior end regulating members 6*a* and 6*b* are inserted in the slits 7 corresponding to A4R and the engagement hole 12 provided in the support section 11 is engaged with the boss section 8 corresponding to A4R to achieve positioning, and finally the covering members 15*a* and 15*b* are fitted, thereby completing size setting.

Figure 4A:
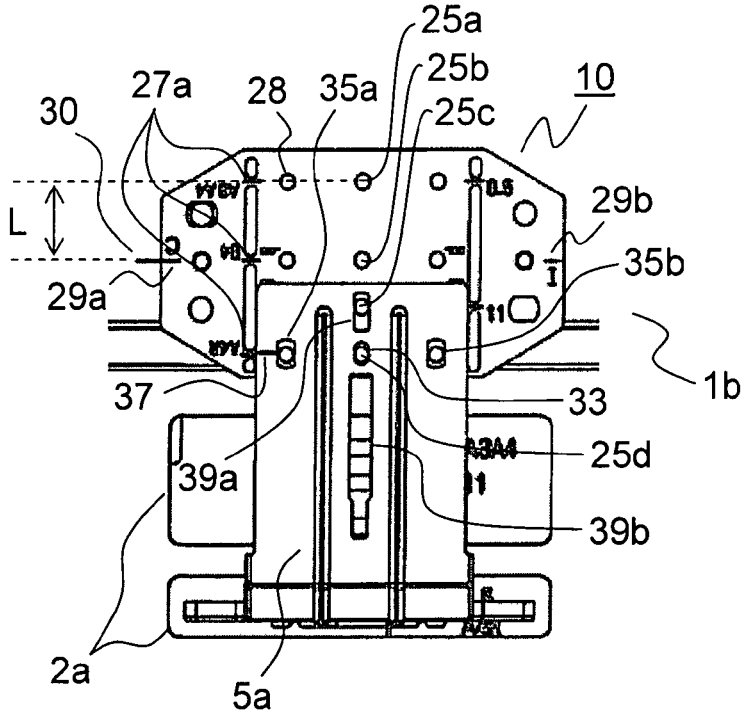
FIG. 4 is an enlarged top view of the surrounding of the positioning member showing a condition that the width regulating member is set for an A4R size.
Figure 4B:
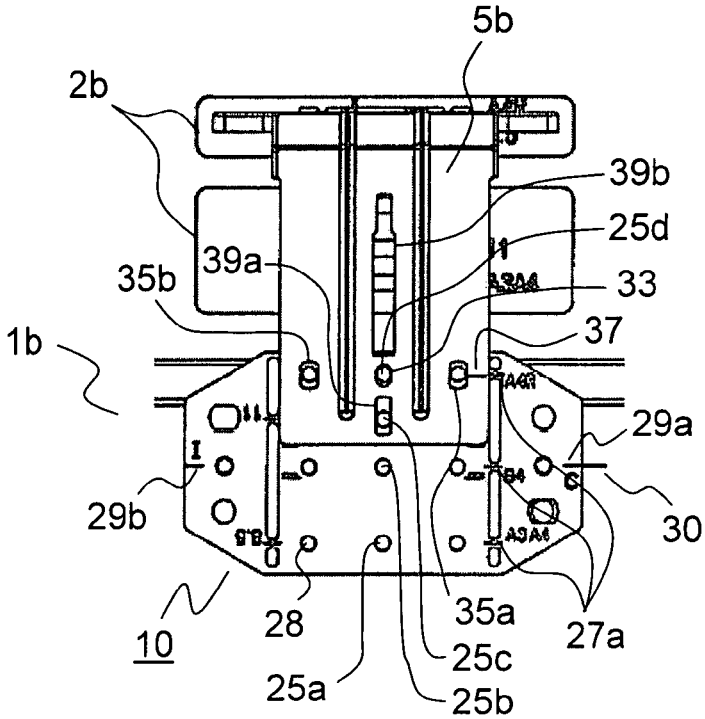

The positioning member 10 is shared between the width regulating member 5*a* side and the width regulating member 5*b* side. Thus, as shown in FIGS. 4A and 4B, when the positioning member 10 is fitted to the top surface 1*b*, positions of the scales 27*a* and 27*b* on the width regulating member 5*b* side are opposite to those on the width regulating member 5*a* side. Thus, the fitting reference line 30 and the mark line 37 on the width regulating member 5*b* are provided on the side (right side in the figure) opposite to those on the width regulating member 5*a* side.

Figure 5:
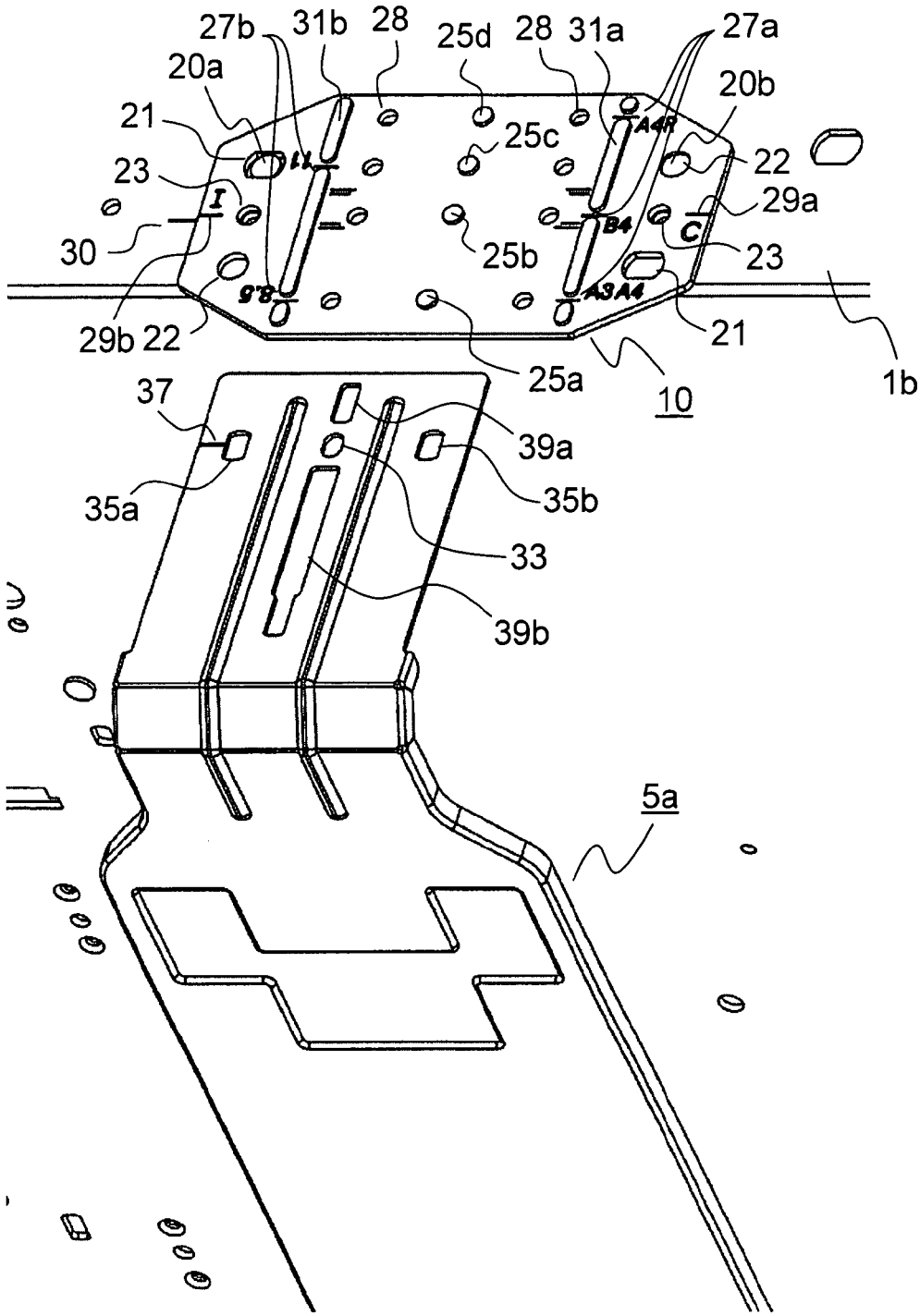
FIG. 5 is an enlarged perspective view of the surrounding of the positioning member when the width regulating member is set in accordance with an inch-based paper size in the paper storage device of the invention.
Figure 6A:
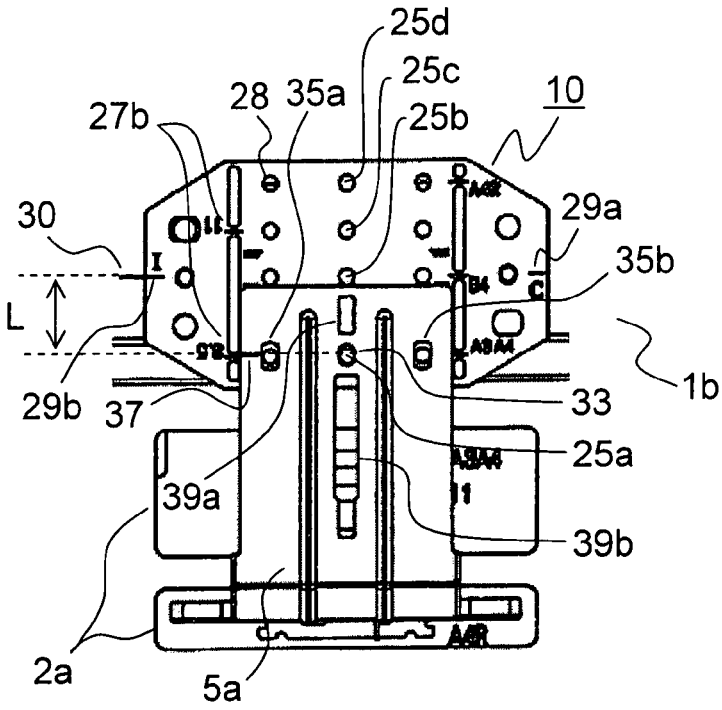
FIG. 6 is an enlarged top view of the surrounding of the positioning member showing a condition that the width regulating member is set for a letter size R.
Figure 6B:
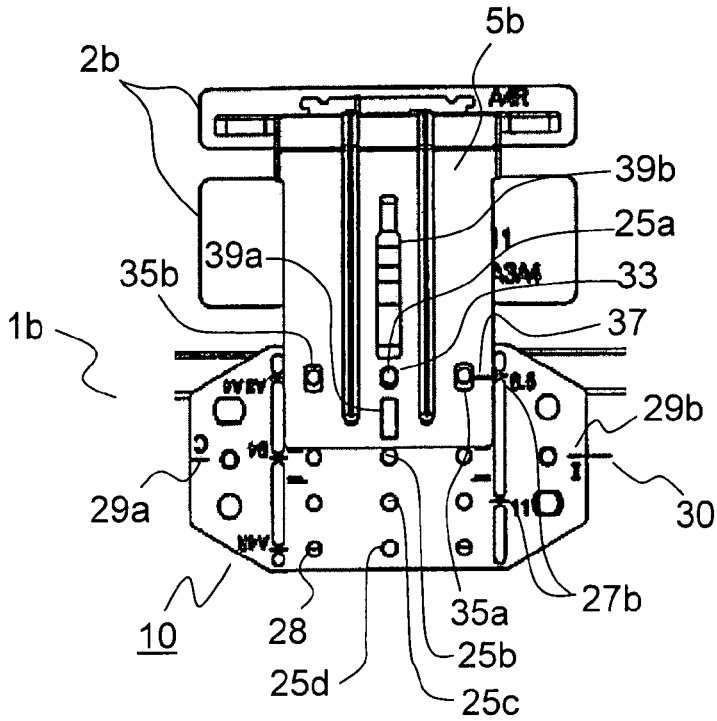

Next, the description will be given referring to a case where the size setting is changed from a metric paper size to an inch-based paper size. FIG. 5 is an enlarged perspective view of the surrounding of the positioning member when the width regulating member is set in accordance with an inch-based paper size. FIG. 6 is an enlarged top view of the surrounding of the positioning member showing a condition that the width regulating member is set for the letter size R (11×8.5 inches). FIG. 5 shows structure on the width regulating member 5*a* side only, while FIG. 6 shows a condition with the covering members 15*a* and 15*b* removed.

For example, in order to change the paper size from the A4R size currently set (see FIG. 4) to the letter size R, the covering members 15*a* and 15*b* are first removed, the adjustment screws (not shown) are loosened to release engagement between the positioning holes 33 of the left and right width regulating members 5*a* and 5*b* and the positioning projection 25*d*, and also a side cover of the paper storage device 100 is opened, and the lower ends of the width regulating members 5*a* and 5*b* are pulled out from the slits 7 (see FIG. 2) in the bottom surface 1*a*.

On the other hand, the fixation screws are pulled out from the screw holes 23 to temporarily remove the positioning member 10 from the top surface 1*b*. Next, the positioning member 10 is horizontally inversed through 180 degrees, and as shown in FIG. 5, the direction indication line 29*b* on the scale 27*b* side where a letter "I" for inch-based display is marked is aligned with the fitting reference line 30, and then the boss holes 21 and 22 are engaged with the support bosses 20*a* and 20*b*. Then, the fixation screws are threaded again into the screw holes 23 to fix the positioning member 10 to the top surface 1*b*.

As a result, the width regulating members 5*a* and 5*b* can be now set in accordance with the inch-based paper size. In FIG. 5, engagement of either of the positioning projections 25*a* and 25*c* with the positioning hole 33 permits positioning corresponding to either of two types of paper widths 8.5 inches and 11 inches, that is, any of four types of paper sizes, i.e., legal size (14×8.5 inches), letter size R (11×8.5 inches), leisure size (17×11 inches), and letter size (8.5×11 inches).

Then, the lower ends of the width regulating members 5*a* and 5*b* are inserted in the slit 7 in the bottom surface 1*a* corresponding to the letter size R, and as shown in FIG. 6, the positioning hole 33 is engaged with the positioning projection 25*a* corresponding to a paper width of 8.5 inches of the letter size R. In this condition, the mark line 37 faces a display "8.5" on the scales 27*b*, thus permitting the operator to easily confirm the size setting.

Further, as with FIG. 4, the arrangement of the width regulating members 5*a* and 5*b* is finely adjusted within the positioning hole 33 and the through holes 35*a* and 35*b*, in which condition the width regulating members 5*a* and 5*b* and the positioning member 10 are fixed together with the fixation screws (not shown). Then, after positioning of the posterior end regulating members 6*a* and 6*b*, the covering members 15*a* and 15*b* are fitted, thereby completing size change to the letter size R. To change the paper size from the state in FIG. 6 to a metric size, the positioning member 10 may be inverted again through 180 degrees to restore the state of FIG. 3, and the positioning of the width regulating members 5*a* and 5*b* may be performed in accordance with the procedures described above.

The structure of the invention permits adjustment of the width regulating member 5*a* or 5*b* in accordance with a metric or inch-based paper size only by inverting the fitting direction of the positioning member 10 through 180 degrees, which ensures quick and reliable adjustment operation. Even when the width regulating members are arranged closely to each other as is the case with the A4 size and the letter size, an interval between the corresponding positioning projections can be broadened to some extent. This reduces adjustment error of making adjustment to improper position with respect to the paper size, and also avoids interference between the width regulating members and the positioning projection. Therefore, positioning members respectively corresponding to a metric size and an inch-based size do not have to be provided separately, thus permitting reduction in the number of components.

Further, shapes and structure of the positioning member 10 and the width regulating members 5*a* and 5*b* are simplified, thus resulting in a larger degree of freedom in design and also providing manufacturing cost advantages. Judging in which direction the positioning member 10 is fitted can be easily made by aligning with the fitting reference line 30 the direction indication line 29*a* marked with the letter "C" or the direction indication line 29*b* marked with the letter "I".

In the embodiment described above, it is designed to satisfy relationship (paper width for the letter size R)/2+2L=(paper width for the A3 and A4 sizes)/2 where a distance from the positioning projection 25*a* to a straight line (the fitting reference line 30 here) passing through the rotational center of the positioning member 10 and vertical to the moving direction of the width regulating members 5*a* and 5*b* is L (mm). That is, the paper width of the letter size R is 216 mm and the paper width for the A3 and A4 sizes is 297 mm; thus, 216/2+2L=297/2, L=(297-216)/4=20.25(mm) is provided.

As a result, the positioning projection 25*a* is arranged, by the inversion of the positioning member 10, at the position corresponding to the A3 and A4 sizes and at the position corresponding to the letter size R (and legal size) which is located in line-symmetry with respect to the fitting reference line 30 as an axis. Therefore, the positioning projection For example, the positioning projection for the A3 and A4 sizes and the positioning projection for the letter size R and the legal size can be provided separately. That is, the number, arrangement, and the like, of the positioning projections described above are just one example. Thus, change can be made as appropriate in accordance with a type of paper size storable in the paper storage device.

In the embodiment described above, the positioning hole 33 is provided as the first engagement section on the width regulating member 5*a* and 5*b* sides, and the positioning projections 25*a* to 25*d* are provided as the second engagement sections on the positioning member 10 side. Alternatively, one positioning projection may be provided as the first engagement section on the width regulating member 5*a* and 5*b* sides, and a plurality of positioning holes may be provided as the second engagement section on the positioning member 10 side. Or, a tongue that is formed by bending the tip ends of the width regulating members 5*a* and 5*b* downward may be defined as the first engagement section and a plurality of grooves into which the tongue is inserted may be formed on the positioning member 10 side and defined as the second engagement section. To form the positioning hole or the grooves on the positioning member 10 side, it is preferable that engagement with the positioning projection or the tongue may be made with a predetermined clearance provided so that fine adjustment of the width regulating members 5*a* and 5*b* can be made. In this case, the openings 39*a* and 39*b* are not necessary.

The invention includes: a paper storage section that stores paper; an elevating plate that is vertically movable in the paper storage section; a width regulating member which has both ends thereof detachably supported on the bottom and top surfaces of the paper storage section and which projects further above the highest elevation position of the elevating plate. In a paper storage device which performs positioning of the width regulating member in the direction orthogonal to the paper transport direction to thereby align the widthwise ends of paper of a plurality of sizes stored on the elevating plate to regulate the paper storage position, a positioning member is arranged on the top surface of the paper storage section. The positioning member has: a plurality of second engagement sections which selectively engage with a first engagement section on the width regulating member side and a plurality of scales which display paper sizes respectively corresponding to the second engagement sections. Arranging the positioning member by horizontally inverting it through 180 degrees permits switching between positioning corresponding to a metric paper size and positioning corresponding to an inch-based paper size.

Consequently, just by inverting through 180 degrees the fitting direction of one type of the positioning member with simple configuration, the width regulating members corresponding to a metric and inch-based paper sizes can be quickly and reliably positioned, thus providing a simple, low-cost paper storage device with excellent maintenancibility.

The plurality of scales displaying the respective paper sizes are provided separately on the left and right of the second engagement sections for a metric paper size and an inch-based paper size, so that the scale corresponding to the second engagement section used for positioning faces a mark line on the width regulating member side, thereby providing the paper storage device which permits easy size confirmation upon paper size change. Further, providing a direction indication line determining the arrangement direction of the positioning member permits easily confirming at which of the metric size and the inch-based size a display is set, thereby preventing error in arrangement of the positioning member upon paper size change.

Moreover, the width regulating member is slidable with respect to the positioning member within a clearance between the first engagement section on the width regulating member side and the second engagement section on the positioning member side. Thus, even when there is variation in regular paper sizes, the width regulating member can be finely adjusted in accordance with the width variation, thus providing a paper storage device which is less likely to encounter paper skew and paper jam.

The first engagement section is provided as a positioning hole, the second engagement section is provided as a positioning projection, and the width regulating member is provided with an opening which avoids interference with the positioning projection not used for engagement, thus simplifying a mechanism of engagement between the width regulating member and the positioning member. Further, arrangement of the positioning projection at such a position that permits shared use for inch-based size positioning and metric size positioning can reduce the number of positioning projections. This makes user's positioning operation simpler and easier to understand and also permits compactification of the positioning member.

What is claimed is:

1. A paper storage device comprising:

a paper storage section which stores paper;

an elevating plate which is vertically movable in the paper storage section;

a width regulating member which has a first engagement section, which has both ends thereof detachably supported on a bottom surface and a top surface of the paper storage section, and which projects further above a highest elevation position of the elevating plate; and a positioning member which is arranged on the top surface of the paper storage section and which has a plurality of second engagement sections selectively engaging with the first engagement section on the width regulating member side and a plurality of scales which display paper sizes respectively corresponding to the second engagement sections, wherein the positioning member is so arranged as to be horizontally inverted through 180 degrees, thereby permitting switching between positioning by the width regulating member corresponding to a metric paper size and positioning by the width regulating member corresponding to an inch-based paper size.

2. The paper storage device according to claim 1, wherein the plurality of scales are provided on left and right of the second engagement sections separately for a metric paper size and an inch-based paper size, and when the first engagement section is engaged with the second engagement section in accordance with arrangement of the positioning member, the scale displaying the paper size corresponding to the second engagement section faces a mark line on the width regulating member side.

3. The paper storage device according to claim 1, wherein, on both a left and a right ends of the positioning member, a direction indication line is provided which is aligned with a fitting reference line on the top surface of the paper storage section to determine arrangement direction of the positioning member.

4. The paper storage device according to claim 2, wherein, on both a left and a right ends of the positioning member, a direction indication line is provided which is aligned with a fitting reference line on the top surface of the paper storage section to determine arrangement direction of the positioning member.

5. The paper storage device according to claim 1, wherein the first engagement section and the second engagement section are engaged with each other with a predetermined clearance being provided therebetween in a moving direction of the width regulating member, and the width regulating member is slidably fixed to the positioning member within the clearance.

6. The paper storage device according to claim 2, wherein the first engagement section and the second engagement section are engaged with each other with a predetermined clearance being provided therebetween in a moving direction of the width regulating member, and the width regulating member is slidably fixed to the positioning member within the clearance.

7. The paper storage device according to claim 3, wherein the first engagement section and the second engagement section are engaged with each other with a predetermined clearance being provided therebetween in a moving direction of the width regulating member, and the width regulating member is slidably fixed to the positioning member within the clearance.

8. The paper storage device according to claim 1, wherein the first engagement section is a positioning hole formed in the width regulating member, the second engagement section is a positioning projection formed in the positioning member and engaging with the positioning hole, and the width regulating member is provided with an opening for, when the positioning hole is engaged with any of the positioning projections, avoiding interference with the other positioning projections.

9. The paper storage device according to claim 1, wherein relationship (inch-based paper size width)/2+2L=(metric paper size width)/2 is satisfied where a distance from a straight line passing through a rotational center of the positioning member and vertical to a movement direction of the width regulating member to any of the second engagement sections is L.

10. The paper storage device according to claim 9, wherein the second engagement section satisfying the relationship (inch-based paper size width)/2+2L=(metric paper size width)/2 corresponds to a minimum inch-based paper size width and a maximum metric paper size width.

* * * * *